US007108600B1

(12) United States Patent
Krzyskowski et al.

(10) Patent No.: US 7,108,600 B1
(45) Date of Patent: Sep. 19, 2006

(54) AIR DUCT REGISTER

(76) Inventors: Steven P. Krzyskowski, 9459 Newton Pl., Commerce, MI (US) 48390; Daniel L. Ritchie, 1563 Chevy Circuit, Rochester Hills, MI (US) 48306

( * ) Notice: Subject to any disclaimer, the term of this patent is extended or adjusted under 35 U.S.C. 154(b) by 0 days.

(21) Appl. No.: 10/826,821

(22) Filed: Apr. 16, 2004

Related U.S. Application Data

(60) Provisional application No. 60/463,701, filed on Apr. 17, 2003.

(51) Int. Cl.
*F24F 13/06* (2006.01)

(52) U.S. Cl. ..... 454/332; 454/292; 454/331

(58) Field of Classification Search ..... 454/292, 454/330, 331, 332, 300
See application file for complete search history.

(56) References Cited

U.S. PATENT DOCUMENTS

| | | | | | |
|---|---|---|---|---|---|
| 1,756,143 | A | * | 4/1930 | Ahl | 454/330 |
| 1,961,497 | A | * | 6/1934 | Klomparens | 454/331 |
| 2,466,353 | A | * | 4/1949 | Babcock | 454/309 |
| 2,790,376 | A | * | 4/1957 | Kennedy et al. | 454/331 |
| 3,504,618 | A | * | 4/1970 | Rosner | 454/332 |
| 3,577,904 | A | * | 5/1971 | Lambert | 454/301 |
| 4,175,936 | A | * | 11/1979 | Lough et al. | 55/385.2 |
| 4,625,632 | A | * | 12/1986 | Markman et al. | 454/290 |
| 4,750,411 | A | * | 6/1988 | Eversole | 454/292 |
| 5,095,942 | A | * | 3/1992 | Murphy | 137/561 A |
| 5,109,756 | A | * | 5/1992 | Barboza et al. | 454/284 |
| 5,236,391 | A | * | 8/1993 | Schaefer | 454/253 |
| 5,281,187 | A | | 1/1994 | Whitney, Jr. | 454/296 |
| 5,338,255 | A | | 8/1994 | Akehurst | 454/292 |
| 5,410,782 | A | | 5/1995 | Holyoake | 24/505 |
| 5,411,438 | A | | 5/1995 | White et al. | 454/300 |
| 5,921,592 | A | * | 7/1999 | Donnelly | 285/340 |
| 5,924,922 | A | * | 7/1999 | Eakin et al. | 454/256 |
| 6,093,890 | A | | 7/2000 | Grotz | 174/58 |
| 6,102,360 | A | | 8/2000 | Clegg et al. | 248/906 |
| 6,346,674 | B1 | | 2/2002 | Gretz | 174/58 |
| 6,478,673 | B1 | * | 11/2002 | Haynes | 454/292 |

* cited by examiner

*Primary Examiner*—Gregory Wilson
(74) *Attorney, Agent, or Firm*—John R. Benefiel

(57) ABSTRACT

The present invention provides an air duct registrer for adding forced air (heat, air conditioning), exhausting air or simply to balance air quality. The air duct register has a manifold and is designed with a removable manifold collar connectible to the flexible or rigid duct. The manifold has thumb cam fasteners to provide ease of installation from below the finished ceiling. With the duct in place above the ceiling elevation, the appropriate opening can be cut and all connections can be made below ceiling elevations via the manifold collar opening. The duct is routed through the manifold opening and connected onto the manifold collar retainer barbs. The manifold collar plate can then be snapped securely into the manifold. The grille then slides into the manifold and is pushed tight to the finished ceiling.

18 Claims, 3 Drawing Sheets

AIR DUCT REGISTER

This application claims priority of Provisional Patent Application 60/463,701 filed on Apr. 17, 2003.

FIELD OF THE INVENTION

The present invention relates to air duct registers, in particular to air duct registers installed into ceilings for the purpose of heating, cooling and ventilating areas.

BACKGROUND OF THE INVENTION

Air conditioning and/or heating ducts are often installed above the ceiling in buildings. The supply and return ducts are generally disposed above the level of the ceiling whether it is a sheet rock (gypsum board) ceiling, or a suspended ceiling or any other type ceiling. These main supply and return ducts usually communicate with the interior of the room through vent assemblies that are supported by the ceiling material or within a framed section of a suspended ceiling. Installing the air duct registers in above described ceiling applications can be very difficult, time consuming and frustrating for the installer.

One problem associated with securing a register to the end of a duct is the securing of the register to the ceiling material or to the suspended ceiling material. One reason for this problem is that ceiling materials such as sheet rock, thin paneling, or plaster are generally incapable of securely holding a fastener which holds the register in place in the ceiling. Over time the ceiling material weakens and eventually breaks apart or splinters.

Another problem encountered is the actual connection of the ductwork to the air duct register. Once the ceiling is in place, the installer is working blindly to connect the end of the duct with the register.

SUMMARY OF THE INVENTION

It is the intent of the present invention to provide an air duct register that addresses the aforementioned concerns.

According to the invention, an air duct register is provided for use in a finished ceiling in a room for connection to a flexible duct located above the ceiling. In one aspect of the invention, the air duct register includes a manifold housing adapted for connecting to the flexible duct wherein the housing provides a fluid passageway from the duct to the room. The air duct register also includes a ceiling clamp operably associated with the manifold housing for attaching the manifold housing within a hole of the ceiling wherein the ceiling clamp has an actuator accessible from below the finished ceiling.

In another aspect of the invention, the air duct register includes a removable manifold collar releasibly attachable to the manifold housing and also releasibly attachable to the flexible duct.

In another aspect of the invention, the manifold housing has a first access opening at one end of the housing positionable in the hole in the ceiling and a second access opening in a sidewall of the housing positioned 90° from the first access opening and wherein the removable manifold collar is releasibly attachable to the housing within the second access opening.

In yet another aspect of the invention, the air duct register further includes a rotatable door releasibly attachable to the manifold collar wherein the door is positionable between a fully open and a fully closed position for regulating the air through the passageway formed by the manifold.

The present invention provides for a tool-free installation of the air manifold diffuser for adding air movement, exhausting air, or balancing air pressure in a room. The present invention can be used for new construction as well as retrofit applications.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
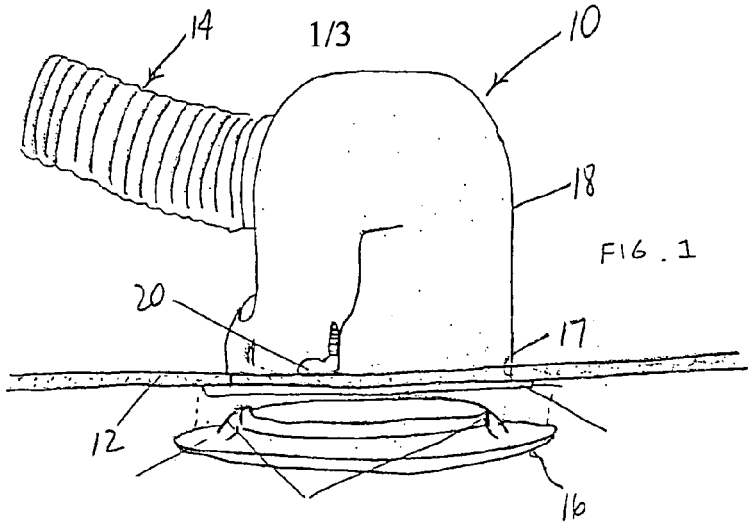
FIG. 1 is a schematic view of an air duct register according to the present invention installed in a ceiling.
Figure 8:
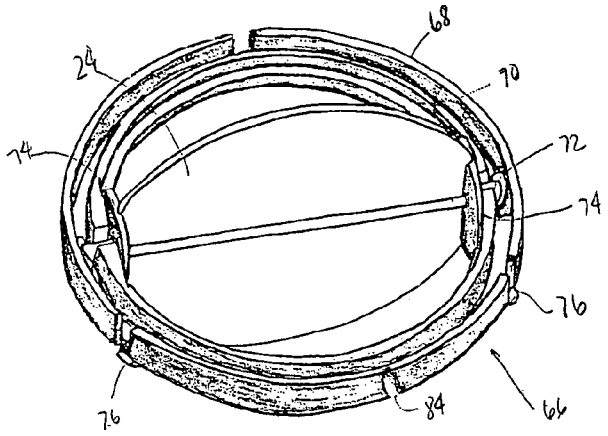
FIG. 8 is perspective view of a rotating door connectible to the duct collar in the partially open position.
Figure 9:
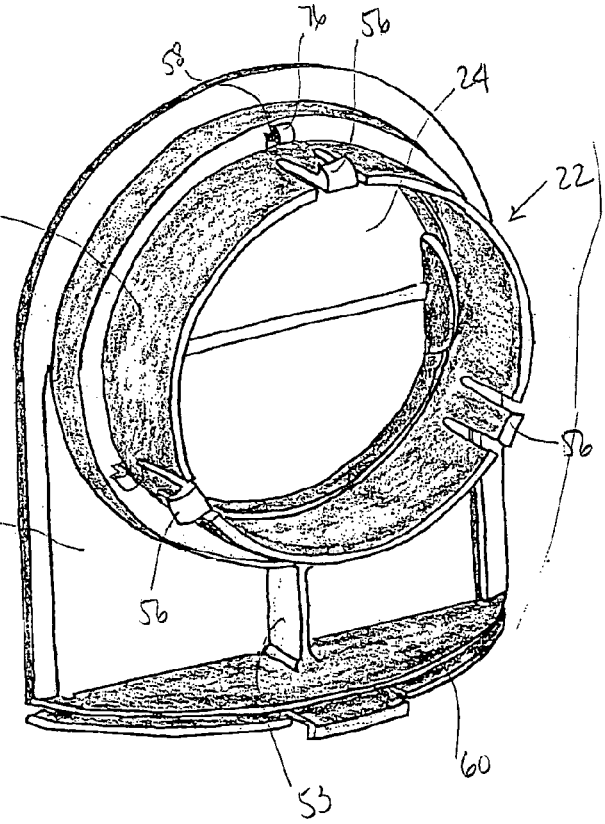
FIG. 9 is a perspective view of the duct collar having the rotating door in the closed position connected thereto.

Referring to one aspect of the invention, FIG. 1 shows an air duct register 10 for installation in a finished ceiling 12 is shown therein. The finished ceiling 12 can be made of sheet rock (gypsum board), thin paneling, plaster, or other conventional material. The air duct register 10 is provided for connection to a flexible or rigid duct 14 located above the ceiling 12. The air duct register 10 receives conditioned air from the flexible duct 14 and channels the conditioned air through a grille or diffuser 16. FIGS. 2–5 and FIG. 8 show components for the air duct register of the present invention. The air duct register 10 includes a manifold 18 having a clamp assembly 20 connected thereto. The air duct register 10 of the present invention also includes a separate piece 22 as well as the grille or diffuser 16. The piece 22 may optional mount a revolving or rotating door 24 as shown in FIGS. 8 and 9. The aforementioned components are made of plastic material to provide a lightweight, inexpensive air duct register that improves air flow, reduces sound and lowers static pressures.

Figure 2:
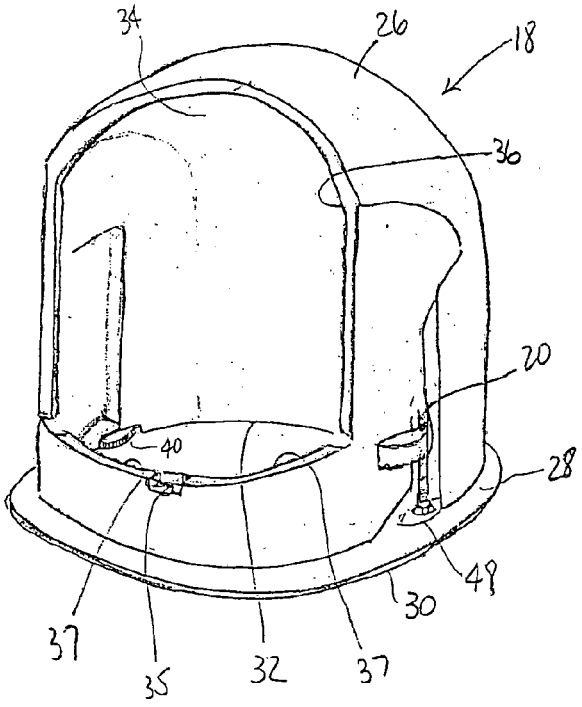
FIG. 2 is a perspective view of a manifold of the present invention having a clamp assembly for the air duct register.
Figure 3:
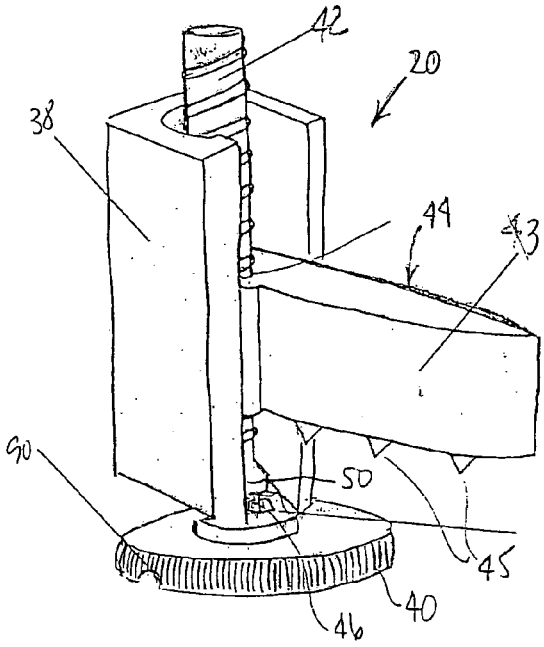
FIG. 3 is a perspective view of the clamp assembly.
Figure 4:
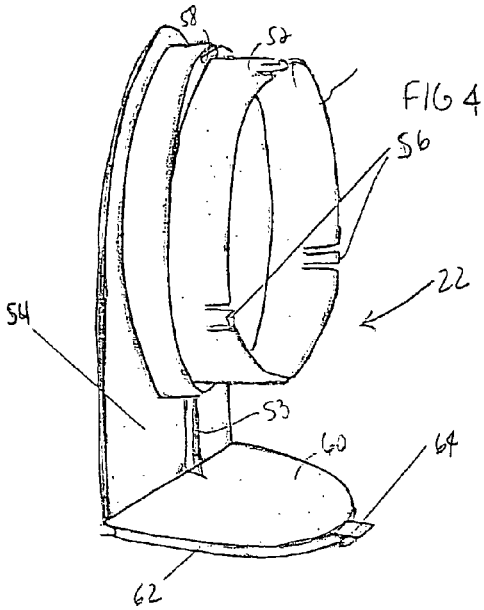
FIG. 4 is a perspective view of a duct collar for the air duct register.
Figure 10:
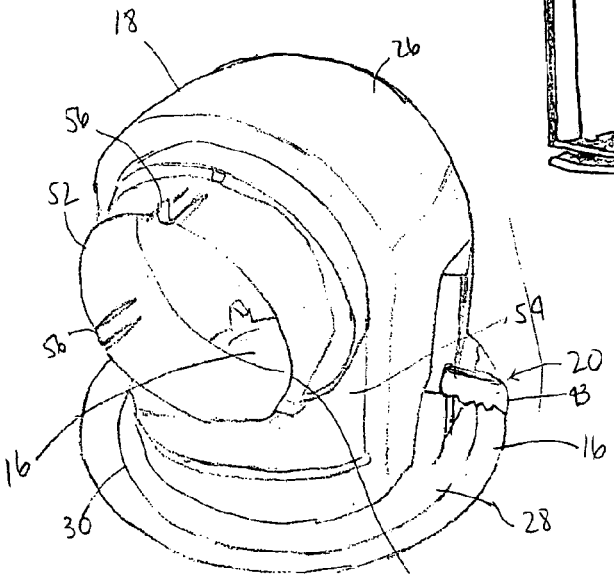
FIG. 10 is a perspective view of a fully assembled air duct register without the optional door.

Referring next to FIGS. 2 and 3, there is shown the manifold which consists of a manifold housing 26 having an essentially dome-shaped configuration. The dome-shaped manifold housing 26 has a flange 28 extending around the periphery of the bottom of the housing 26. The outer periphery 30 of the flange 28 is used as a template for marking the required hole in the ceiling as will be discussed further hereinafter. The inner periphery 32 of the flange 28 defines bottom opening 32 extending into the interior 34 of the dome-shaped housing 26. The housing 26 also has a side access aperture 36 sized and configured for receiving the duct collar piece 22 therein to be closed off as shown in FIG. 10. The side access aperture 36 is located 90° relative to the flange 28 and the bottom opening 32.

A pair of clamp assemblies 20 are located 180° from each other and located on each side of the side access aperture 36. Portions of the clamp assemblies 20 are shown in FIG. 2 and a single enlarged clamp assembly 20 is shown in FIG. 3. The ceiling clamp assembly 20 is operable for clamping the ceiling 12 between the flange 28 of the manifold 18 and the clamp assembly 20. The clamp assembly 20 includes a clamp guide 38, a thumb cam 40 having an integrally threaded stem 42 and a ceiling clamp 44. The clamp guide 38 is integrally formed with the housing 26. The clamp guide 38 forms a path for the integrally threaded stem 42; and is positioned around the stem 42 for keeping the ceiling clamp assembly 20 in a rotationally fixed position relative to the thumb cam 40. The ceiling clamp 44 is threadingly engageable with the integrally threaded stem 42 such that when the thumb cam 40 is rotated in one direction, the ceiling clamp 44 moves closer to the thumb cam 40. When the thumb cam 40 is rotated in the opposite direction, the ceiling clamp 44 moves away from the thumb cam 40. The ceiling clamp 44 can only move axially away from and toward the thumb cam 40. The threaded stem 42 has an unthreaded portion 46 positioned adjacent to the thumb cam 40 and located within an aperture for the base 48 of the clamp guide 38 and through the flange 28. Therefore the thumb cam 40 is located on the opposing side of the flange 28 from the clamp guide 38 so that the thumb cam 40 is visible and accessible to the installer from below the ceiling 12. The thumb cam 40 is a flat circular disc having a rigid edge to facilitate the installer to manually turn the cam without the use of a tool. The unthreaded portion 48 has a small lip 50 positioned above the base 48 to maintain the thumb cam 40 with its integral threaded stem 42 in position within the clamp guide 38. Each ceiling clamp 44 has a wing 43 which extends away from the stem 42. As the thumb cam 40 is rotated, the wing 43 rotates relative to the stem 42 as the ceiling clamp moves axially along the stem 42 to place the wing 43 in engagement with the ceiling material for securing thereto. The wing 43 may also have teeth 45 along its lower edge for further gripping into the ceiling material.

FIGS. 4, 4*a*, 6, and 9 show the separate cover piece 22. As will be explained hereinafter, the cover piece 22 provides a mounting means for connecting the flexible or rigid duct 14 to the air duct register 10. The cover piece 22 includes a tubular collar 52 extending from a wall 54 extending outwardly from the duct collar 52. The collar 52 defines a center through opening. The circular collar 52 has at least one but preferably a plurality of retainer barbs 56 for holding the flexible ro rigid duct 14 onto the collar 52 without the need for a hose clamp or other separate tool. Inset from each retainer barb 56 along the periphery of the collar 52 are small apertures 58 for receiving clips to hold an optional door 24, as will be discussed further hereinafter. A second wall 60 integrally connected to a first wall 54 and positioned 90° relative to the first wall 54 has semi-circular configuration for corresponding to the domed exterior configuration of the housing 26. The peripheral edge of the second wall 60 forms a groove 62 for receiving a pair of ledges 37 that extend in from the side opening 36 of the housing 26. A central clip 64 formed in the center of the peripheral edge of the second wall 60 of the cover piece 22 corresponds for latching into a cutout 35 formed between the pair of ledges 37 in the manifold housing 26. Positioning the pair of ledges 37 within the groove 62 and attaching the clip 64 into the cutout 35 cooperates to secure the cover piece 22 covering the side aperture 36 of the housing 26.

Figure 4A:
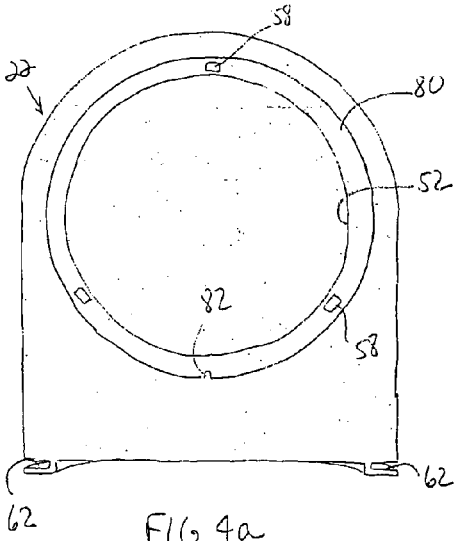
FIG. 4*a* is an elevational view of the rear wall of the duct collar.

The tubular collar 52 of the cover piece 22 defines a tubular passageway to allow regulated air to be moved between the room and the air duct 14 via the manifold housing 26. The passageway formed by the tubular collar 52 may optionally be opened or closed by a door assembly 66. The door assembly 66 is best shown in FIG. 8. The door assembly 66 includes a ring 68 defining a central passageway therebetween and a circular planar door 24 sized so that the door 24 closes the passageway through the ring 68. The door 24 has pins 72 extending from the circumferential sides of the door and positioned 180° from each other. The pins are rotatably held to the ring and maintained in position in a gate 74 located adjacent to each pin 72. The door 24 is movable to rotate 90° from a fully closed position through a fully open position. The door assembly 66 is connected to the collar 52 by means of tabs 76. As shown in FIG. 4*a*, the inner side of the first wall 54 has a circumferential recess 80 concentratric with the circular flange 52. The circumferential recess 80 is sized for receiving the ring 68 of the door assembly 66. The recess 80 has a plurality of through slots 58 for receiving the tabs 76 of the door assembly 66. To properly align the door assembly 66 within the recess 80, the recess includes a rib 82 for alignment with a corresponding slot 84 in the outer surface of the ring 68. FIG. 9 shows the door assembly 66 assembled to the collar 52 with the door 24 closing the passageway. As also shown in FIG. 9, a supporting rib 53 may be integrally formed along the first wall 54 of the duct collar piece 22 from the circular collar 52 to the second wall 60 to provide additional strength to the duct collar piece 22.

Figure 5:
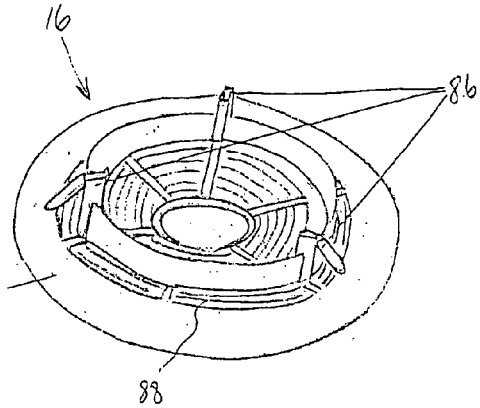
FIG. 5 is a perspective view of a grille or diffuser for the air duct register.

The air duct register 10 of the present invention further includes a grille or diffuser 16. The grille or diffuser 16 is shown in FIGS. 1 and 5. The grille 16 includes a plurality of spring clips 86 for releasably attaching the grille to the manifold housing 26. The grille 16 covers the first access opening 32 of the manifold housing 26. The grille 16 also includes a plurality of vent openings 88 for passing the conditioned air from the flexible or rigid duct 14 into the room.

The air duct register 10 can be easily installed into any finished ceiling 12. The flange 28 of the housing 26 can be used as a template for sizing a hole to be cut into the ceiling 12. The cut for the hole 17 should be approximately ¼ inch inside the template circle. The round manifold housing 26 is inserted through the cutaway portion 17 of the ceiling 12 positioning the first access opening 32 parallel to the ceiling 12. The round manifold housing 26 has a flange 28 having a perimeter with a larger diameter than the round manifold housing 26. The flange 28 is positioned adjacent the finished ceiling 12 when the air manifold assembly 10 is fully installed. The flange 28 prevents the air manifold assembly 10 from completely passing through the cutaway portion 17 of the ceiling 12. The clamp assembly 20 for releasably locking the air manifold assembly housing 26 with respect to the finished ceiling 12 is accessible from underneath the ceiling 12 by reaching up to the exposed thumb cams 40 of the clamp assembly 20. The thumb cams 40 can be tightened manually by hand or with a use of a screw driver in the screw driver slot 90. By tightening the thumb cams 40, the ceiling clamps 44 rotate into engagement with the ceiling material while the teeth 45 grip into the ceiling material.

Figure 6:
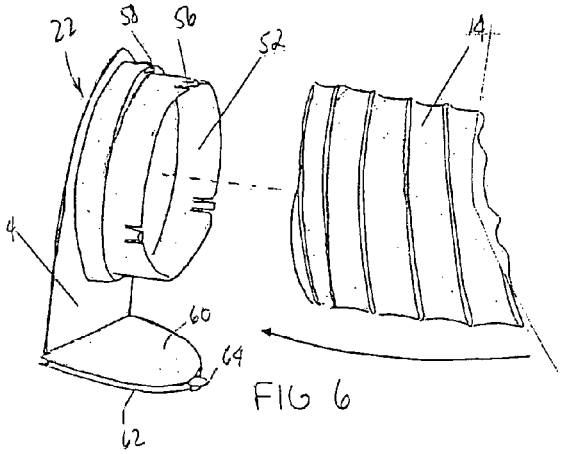
FIG. 6 is a perspective view of an end of a duct connecting to the duct collar.

Once the manifold 18 is installed in the ceiling 12, the duct 14 is brought through the manifold 18 via the much larger side access opening 36 and through the bottom opening 32. The duct 14 is then attached to the collar 52, as shown in FIG. 6. The cover piece 22 is then pushed up through the lower access opening 32, aligned with the opening 26 and pushed against the inside of the housing 26 and attached to housing 26 in position covering the side access opening 30 as discussed supra.

Finally, the grille 16 is releasably snap-locked onto the flange 28 of the manifold housing 26. FIG. 10 shows an assembled air duct register 10 without the door assembly 66.

The air duct register of the present invention is designed to maximize air flow performance over more conventional sheet metal designs. By utilizing plastic materials and injection molding processes it is possible to radius and smooth the shape of the 90° passageway in the manifold 18 which improves air flow, reduces sound and lowers static pressures.

The air duct register of the present invention is further designed with the do-it-yourself home owner handyman in mind. The air duct registers are designed for ease of installation requiring no tools to assemble. The air duct register can be installed into drywall, drop, wood or any finished standard or cathedral ceiling with a minimum clearance of 7-1½ inches from ceiling to top of joist. Once duct 14 is attached, the cover piece 22 can be pushed up into the housing 26 and over the opening 36 and connected to the housing 26 in that position. There is no need to crawl into attic or ceiling to attach clamps or duct elbows to the duct 14.

The air duct register of the present invention can also be used in compliance to building codes requiring balancing of room-to-room air pressures. Two or more units can be connected together to improve room-to-room imbalanced HVAC system air pressures.

Figure 7:
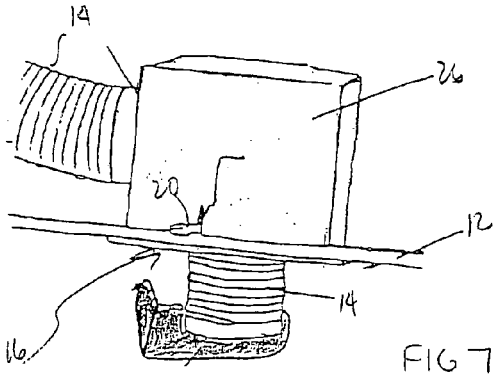
FIG. 7 is a schematic view of a second embodiment of the air duct register having a rectangular configuration.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. One such variation is shown in FIG. 7, where the manifold housing 26 has a rectangular shape with a corresponding shaped first access opening 32.

What is claimed is:

1. An air duct register for use in a finished ceiling in a room for connection to a flexible duct about the ceiling comprising:

a manifold housing adapted for connecting to the duct located above the finished ceiling, said manifold housing having an opening at the bottom to provide a fluid passageway from the duct to the room;

a ceiling clamp operably associated with the manifold housing for attaching in the manifold housing within a hole of the finished ceiling, the ceiling clamp having an actuator accessible from below the finished ceiling; and a separate manifold cover piece attachable to the housing in a position covering an access opening in a side wall of said manifold housing, wherein said access opening has a peripheral edge and at least one portion of the peripheral edge has an inwardly directed ledge, and wherein said cover piece has a groove receiving said ledge with said cover piece positioned over said access opening.

2. The air duct register of claim 1 wherein each ceiling clamp further comprises:

a thumb-cam for actuating the clamp.

3. The air duct register of claim 1 wherein said manifold cover piece is releasably attached to the manifold housing by snap fit portions thereof.

4. The air duct register of claim 3, wherein the manifold collar includes a plurality of retaining barbs for connecting to the flexible duct.

5. The air duct register of claim 1 wherein said access opening in a side wall of the manifold housing is oriented at about 90° to said opening at the bottom.

6. The air duct register of claim 1, wherein the manifold housing has a radiused and smooth interior for the fluid passageway.

7. An air duct register for use in a finished ceiling in a room for connection to a flexible duct extending above the ceiling comprising:

a manifold housing connected to an end of the flexible duct located above the finished ceiling, said manifold housing providing a fluid passageway from the duct to the room;

a ceiling clamp operably associated with the manifold housing for attaching the manifold housing within a hole in the finished ceiling, the ceiling clamp having an actuator accessible from below the finished ceiling; and a separate manifold cover piece attached to the manifold housing and positioned over said access opening formed in a manifold housing side wall, and wherein the manifold piece has a collar receiving said flexible duct end with a through aperture in said collar sized to correspond with the flexible duct and wherein said separate manifold cover piece has portions extending out from said collar configured to cover said access opening when said cover piece is in position against said side wall of said manifold housing.

8. The air duct register of claim 7, wherein said door is held in a ring which is received in said collar and releasably attached thereto.

9. An air duct register according to claim 7 further including:

a rotatable door disposed within the manifold collar, and wherein said door is positionable between a fully open and a fully closed position.

10. The air duct register of claim 9, wherein the door is movable to a position from fully opening the through aperture through fully closing the aperture.

11. An air duct register for use in a finished ceiling in a room adapted to be connected to a flexible duct extending above the finished ceiling comprising:

a manifold housing having an upper portion adapted to be connected to said flexible duct and having a bottom portion adapted to be fit into an opening in said ceiling, said manifold housing substantially enclosing a space defining a passageway directing airflow from said duct into the room;

a bottom opening at said bottom portion of said manifold housing for discharging air flow through said ceiling opening with said housing bottom portion in position within said ceiling opening;

said manifold housing further including a separate cover piece having outer portions configured to cover a side opening in said manifold housing substantially larger than said flexible duct to allow said duct to be easily pulled through said side opening, said side piece configured to be movable in and out of said manifold housing through said bottom opening and readily attachable to said manifold housing in position covering said side opening by interfitting portions of said side wall piece and portions of said manifold housing adjacent said side opening;

said side wall piece formed with a collar having a through opening and a projecting end projecting axially outwardly when said cover piece is located in said position covering said side opening; and a ceiling mounting arrangement carried by said manifold housing for securing said manifold housing to the finished ceiling, said ceiling mounting arrangement accessible from below the finished ceiling to enable mounting of said manifold housing to said finished ceiling, whereby a flexible duct can be pulled through said manifold housing side opening with said side piece detached and out through said housing bottom opening and finished ceiling opening, and thereafter attached to said side wall piece collar with said cover piece separated from said manifold housing, said cover piece and attached flexible duct thereafter being able to be pushed back through said manifold housing bottom opening and said cover piece attached to said manifold housing in said position covering said manifold housing side opening.

12. The air duct register of claim 11 wherein the manifold housing is configured to be inserted up through said finished ceiling opening from below said finished ceiling.

13. The air duct register of claim 11 wherein said ceiling housing arrangement comprises a pair of ceiling clamps mounted to said bottom portion of said manifold housing; and each ceiling clamp includes a thumb screw having a head manually rotatable to actuate a clamping member threaded thereto to engage and grip an adjacent section of said finished ceiling.

14. The air duct register of claim 11, wherein said cover piece and said manifold housing have interfit portions locating and holding said cover piece in said position covering said side opening.

15. The air duct register of claim 14, wherein said manifold housing and cover piece interfit portions are snap fit together to make said cover piece releasably attachable to said manifold housing when positioned covering said side wall opening.

16. The air duct register of claim 15, wherein said manifold housing side opening is defined by a peripheral edge and at least one portion of the peripheral edge has an inwardly directed lip and said cover piece has a mating double edged flange portion for receiving the inwardly directed lip therebetween when said cover piece is installed covering said side opening.

17. The air duct register of claim 16, wherein said side piece said side opening and the bottom of said cover piece has a deflectable tab projecting from said projecting wall aligned with a slot in said housing side opening ledge and snap fit thereto when said cover piece is pushed against said ledge of said side wall opening.

18. A method of installing an air duct outlet in an existing ceiling and connecting the same to a flexible duct extending above the ceiling comprising:

cutting a hole into the ceiling sized to receive a manifold housing open at the bottom with an access opening formed therein substantially larger than said flexible duct to allow said flexible duct to be readily pulled into said manifold housing;

pushing said manifold up into said ceiling hole and mounting the same to said ceiling with the bottom adjacent said ceiling;

pulling an end of said flexible duct into said housing through said access opening and down below said ceiling through said open bottom of said manifold housing, attaching said duct end to a separate cover piece configured to be fit against the inside of said manifold housing so as to block said access opening, said cover piece formed with a collar with a through opening formed therein to which said duct end is attached, and attaching said cover piece to said manifold housing with portions of said cover piece extending outwardly from said collar in position covering said manifold housing and extending over said access opening to block said access opening.

* * * * *